US007101320B2

(12) United States Patent
Qiu

(10) Patent No.: US 7,101,320 B2
(45) Date of Patent: Sep. 5, 2006

(54) DAMPING DEVICE FOR EXERCISING CYCLE

(75) Inventor: Rui-Zung Qiu, Jia Yi (TW)

(73) Assignee: Fitness Products Inc., Ming Hsiung Industrial Park (TW)

( * ) Notice: Subject to any disclaimer, the term of this patent is extended or adjusted under 35 U.S.C. 154(b) by 511 days.

(21) Appl. No.: 10/667,051

(22) Filed: Sep. 22, 2003

(65) Prior Publication Data

US 2005/0064999 A1 Mar. 24, 2005

(51) Int. Cl.
*A63B 22/06* (2006.01)

(52) U.S. Cl. ..... 482/63; 482/57

(58) Field of Classification Search ..... 482/51, 482/57, 58, 60, 61, 63; 310/103, 105
See application file for complete search history.

(56) References Cited

U.S. PATENT DOCUMENTS 5,879,273 A * 3/1999 Wei et al. ..... 482/63
6,620,081 B1 * 9/2003 Phillips ..... 482/57
6,736,761 B1 * 5/2004 Huang ..... 482/57
6,964,633 B1 * 11/2005 Kolda et al. ..... 482/63
7,011,607 B1 * 3/2006 Kolda et al. ..... 482/57

* cited by examiner

*Primary Examiner*—Jerome Donnelly
*Assistant Examiner*—Tam Nguyen
(74) *Attorney, Agent, or Firm*—Alan D. Kamrath; Nikolai & Mersereau, P.A.

(57) ABSTRACT

A damping device includes a support base, a housing, a pivot shaft, a resistance wheel, a magnetic disk, a fixing disk, an action block, two urging balls, and a motor. Thus, the fixing disk is pushed to move relative to the magnetic disk by rotation of the action block to change the distance between the magnetic members of the fixing disk and the magnetic disk, so as to adjust the damping force applied by the resistance wheel on the rear wheel of the exercising cycle, so that the resistance values of the damping device can be adjusted arbitrarily so as to fit the requirements of different users.

15 Claims, 8 Drawing Sheets

DAMPING DEVICE FOR EXERCISING CYCLE

BACKGROUND OF THE INVENTION

1. Field of the Invention

The present invention relates to a damping device, and more particularly to a damping device for an exercising cycle.

2. Description of the Related Art

A conventional damping device for an exercising cycle comprises a resistance wheel rested on the rear wheel of the exercising cycle for providing a damping effect to the rear wheel of the exercising cycle, thereby achieving the exercising effect. However, the resistance values of the damping device cannot be adjusted arbitrarily so as to fit the requirements of different users.

SUMMARY OF THE INVENTION

The primary objective of the present invention is to provide a damping device for an exercising cycle.

Another objective of the present invention is to provide a damping device, wherein the fixing disk is pushed to move relative to the magnetic disk by rotation of the action block to change the distance between the magnetic members of the fixing disk and the magnetic disk, so as to adjust the damping force applied by the resistance wheel on the rear wheel of the exercising cycle, so that the resistance values of the damping device can be adjusted arbitrarily so as to fit the requirements of different users.

A further objective of the present invention is to provide a damping device that can be operated easily and conveniently, thereby facilitating the user operating the exercising cycle.

In accordance with the present invention, there is provided a damping device, comprising:

a support base;

a housing secured on a side of the support base and having an inside formed with a receiving chamber, the housing including a first shell secured on the support base, a middle shell combined with the first shell and having a center formed with a mounting ring, and a second shell combined with the middle shell;

a pivot shaft rotatably mounted on the support base;

a resistance wheel secured on the pivot shaft to rotate therewith;

a magnetic disk mounted in the receiving chamber of the housing and secure on an end of the pivot shaft to rotate therewith;

a fixing disk movably mounted on the mounting ring of the middle shell and having a periphery provided with a plurality of magnetic members aligned with the magnetic disk, the fixing disk having a center formed with a receiving recess having a wall formed with two positioning holes;

an action block rotatably mounted in the receiving recess of the fixing disk and having a periphery formed with two symmetrical guide slots;

two urging balls each mounted in a respective one of the two positioning holes of the fixing disk and each slidably mounted in a respective one of the two guide slots of the action block; and a motor secured on an outer wall of the middle shell of the housing and having a first end provided with a rotatable spindle extended through the fixing disk and fixed in the action block for rotating the action block.

Further benefits and advantages of the present invention will become apparent after a careful reading of the detailed description with appropriate reference to the accompanying drawings.

DETAILED DESCRIPTION OF THE INVENTION

Figure 1:
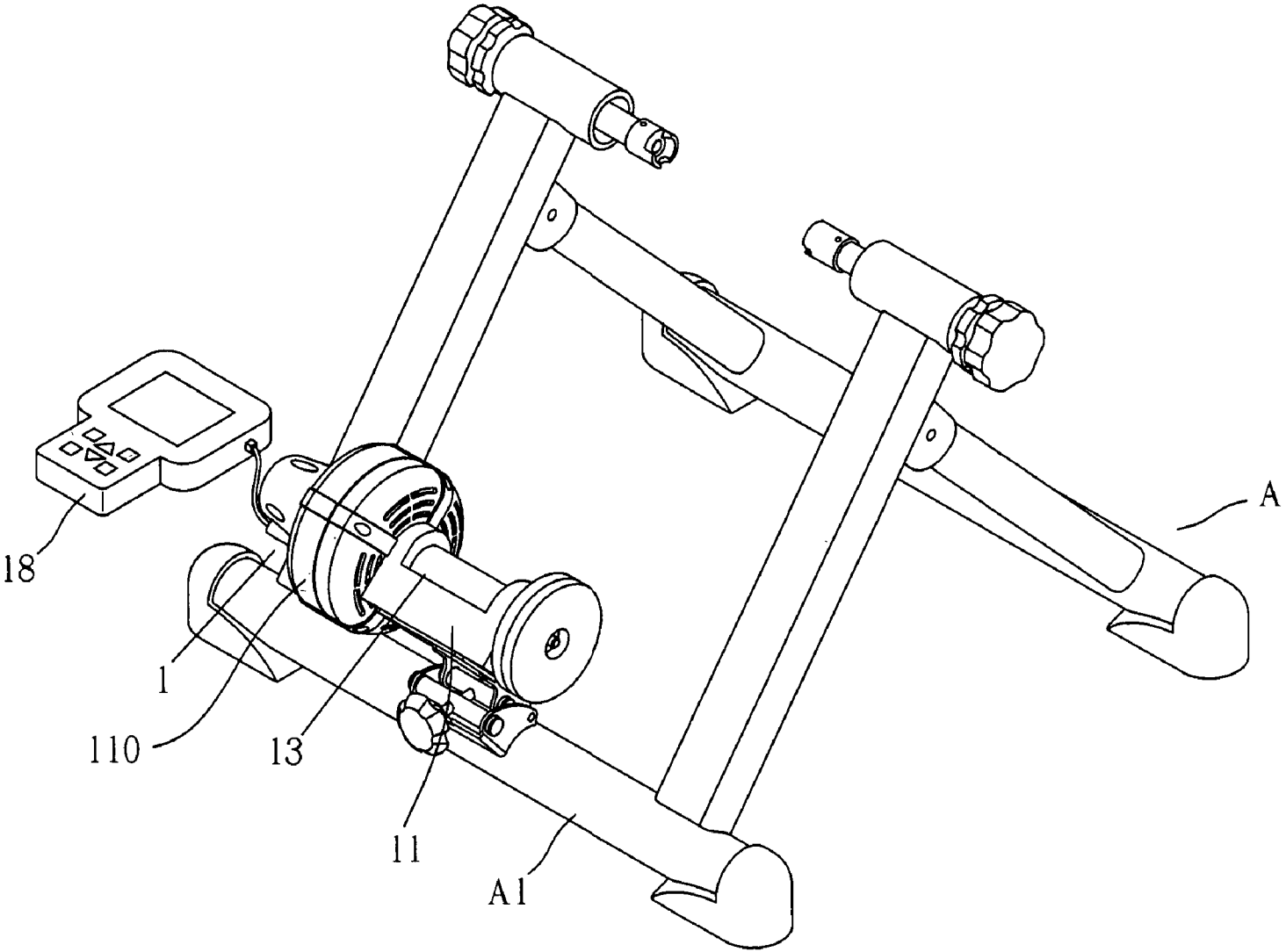
FIG. 1 is a perspective view of a damping device in accordance with the preferred embodiment of the present invention.
Figure 2:
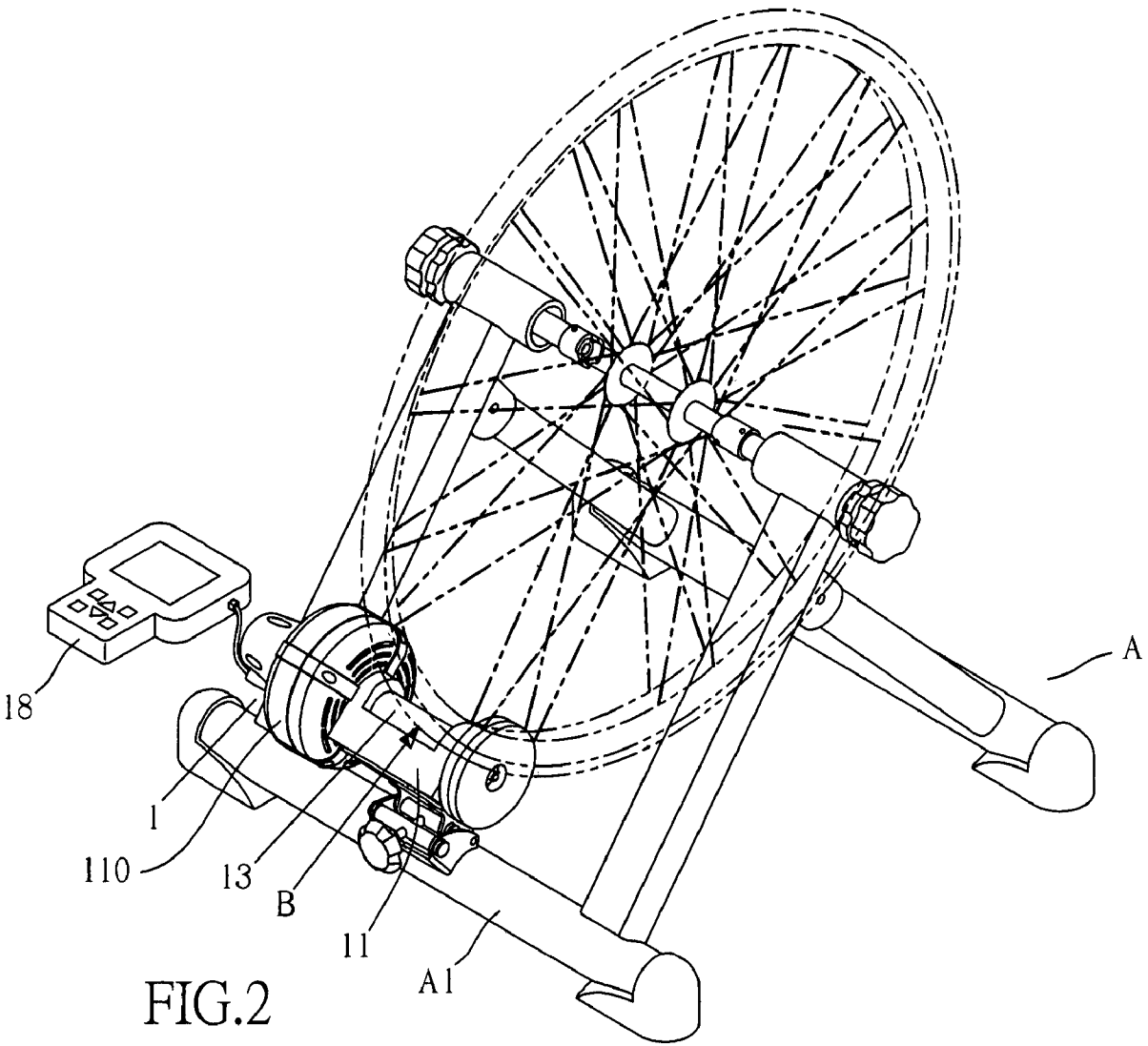
FIG. 2 is a perspective view of the damping device in accordance with the preferred embodiment of the present invention.
Figure 3:
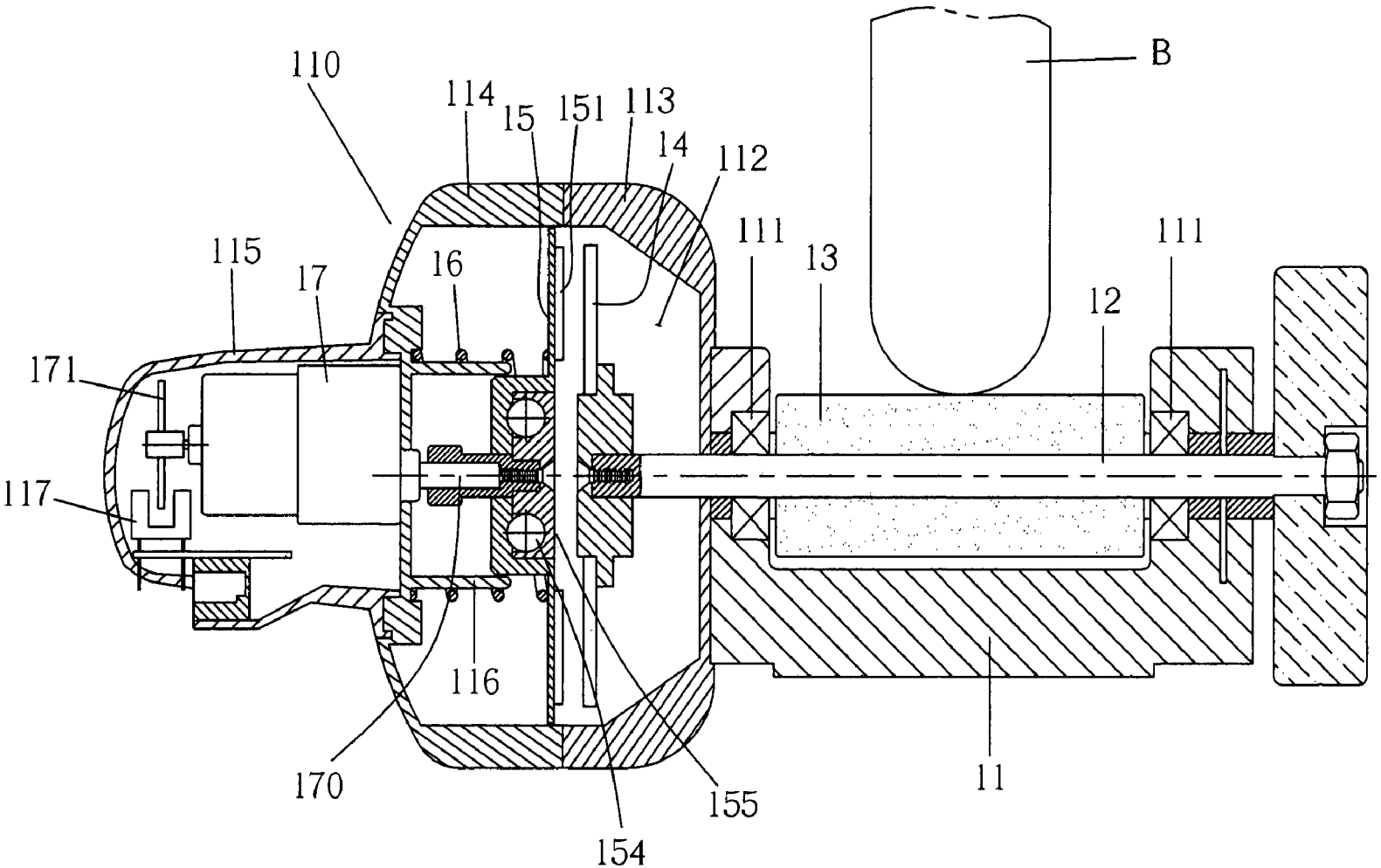
FIG. 3 is a plan cross-sectional view of the damping device as shown in FIG. 2.
Figure 4:
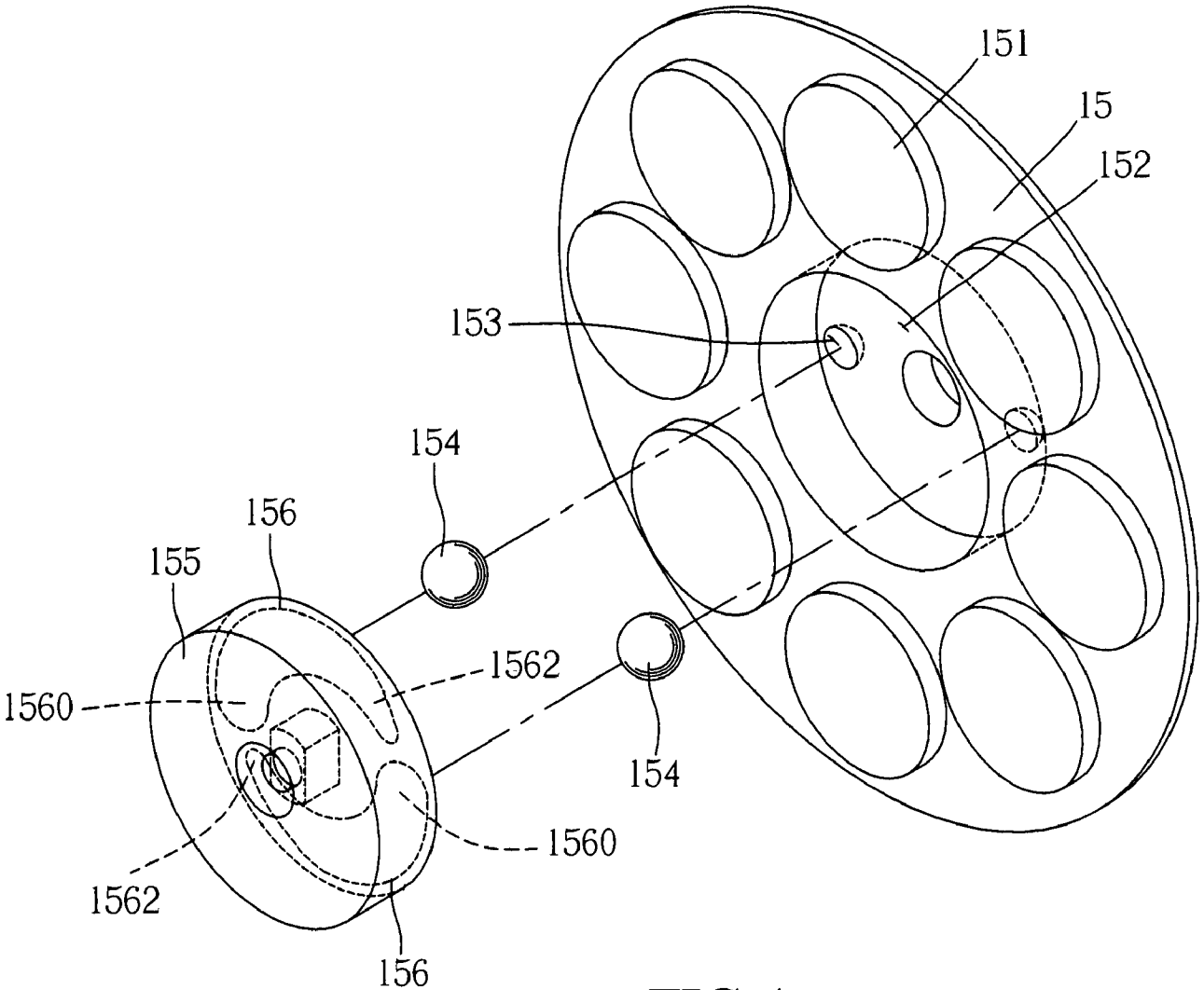
FIG. 4 is a partially exploded perspective view of the damping device in accordance with the preferred embodiment of the present invention.

Referring to the drawings and initially to FIGS. 1–4, a damping device 1 in accordance with the preferred embodiment of the present invention is mounted on the transverse rod A1 of the support frame A of an exercising cycle for providing a damping effect to the rear wheel B of the exercising cycle.

The damping device 1 comprises a support base 11, a housing 110, a pivot shaft 12, a resistance wheel 13, a magnetic disk 14, a fixing disk 15, an elastic member 16, a DC motor 17, and an electronic instrument 18.

The support base 11 is substantially U-shaped and has two sides provided with two bearings 111.

The housing 110 is secured on a side of the support base 11 and has an inside formed with a receiving chamber 112. The housing 110 includes a substantially U-shaped first shell 113 secured on the support base 11, a substantially U-shaped middle shell 114 combined with the first shell 113, and a substantially U-shaped second shell 115 combined with the middle shell 114. The middle shell 114 of the housing 110 has a center formed with a mounting ring 116. The second shell 115 of the housing 110 has an inside provided with a substantially U-shaped infrared sensor 117.

The pivot shaft 12 is rotatably mounted on the support base 11 and is extended through the two bearings 111.

The resistance wheel 13 is secured on the pivot shaft 12 to rotate therewith and is rested on the rear wheel B of the exercising cycle.

The magnetic disk 14 is mounted in the receiving chamber 112 of the housing 110 and is secure on an end of the pivot shaft 12 to rotate therewith.

The fixing disk 15 is mounted in the receiving chamber 112 of the housing 110 and is movably mounted on the mounting ring 116 of the middle shell 114. The fixing disk 15 has a periphery provided with a plurality of magnetic members 151 aligned with the magnetic disk 14 to produce a magnetic force with the magnetic disk 14. Preferably, the magnetic members 151 of the fixing disk 15 are arranged in an annular manner. The fixing disk 15 has a center formed with a receiving recess 152 having a wall formed with two positioning holes 153.

The damping device 1 further comprises an action block 155 rotatably mounted in the receiving recess 152 of the fixing disk 15 and having a periphery formed with two symmetrical arc-shaped guide slots 156, and two urging balls 154 each mounted in a respective one of the two positioning holes 153 of the fixing disk 15 and each slidably mounted in a respective one of the two guide slots 156 of the action block 155. Preferably, each of the two guide slots 156 of the action block 155 has a first end 1560 and a second end 1562 having a depth smaller than that of the first end 1560. Thus, the depth of each of the two guide slots 156 of the action block 155 is gradually decreased from the first end 1560 to the second end 1562.

The elastic member 16 is mounted on the mounting ring 116 of the middle shell 114 and urged between the fixing disk 15 and the middle shell 114 for pushing the fixing disk 15 toward the magnetic disk 14.

The motor 17 is secured on an outer wall of the middle shell 114 of the housing 110. The motor 17 has a first end provided with a rotatable spindle 170 extended through the fixing disk 15 and fixed in the action block 155 for rotating the action block 155. The motor 17 has a second end provided with a rotatable code disk 171 having a periphery received in the infrared sensor 117.

The electronic instrument 18 is connected to the motor 17 to control operation of the motor 17.

Figure 5:
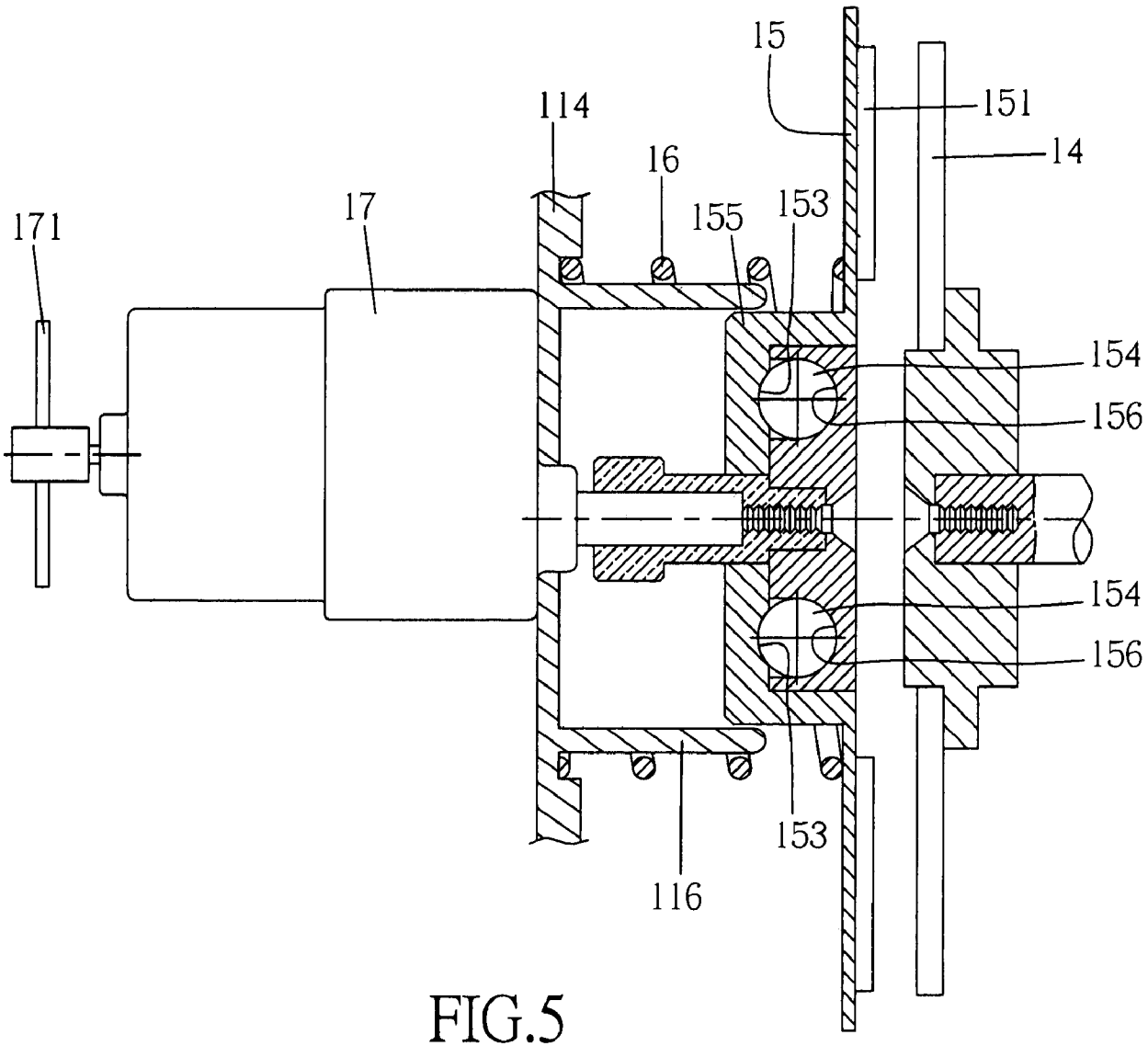
FIG. 5 is a partially enlarged view of the damping device as shown in FIG. 3.
Figure 6A:
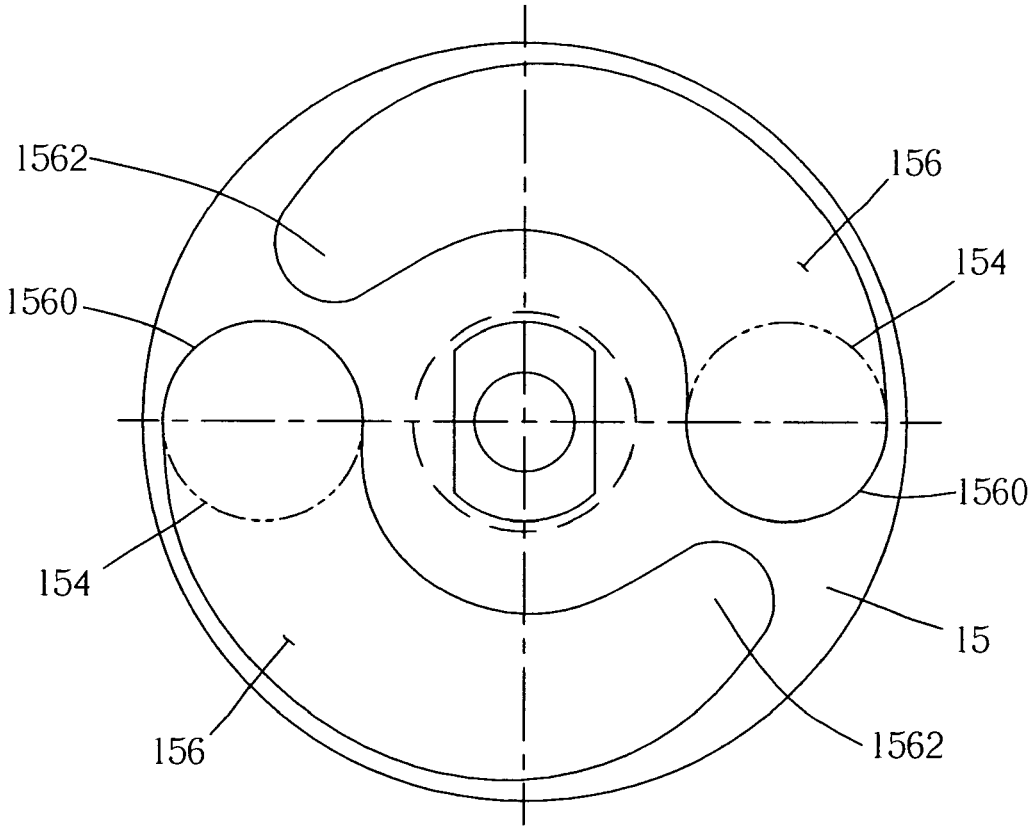
FIG. 6A is a plan view of the damping device as shown in FIG. 6.
Figure 6:
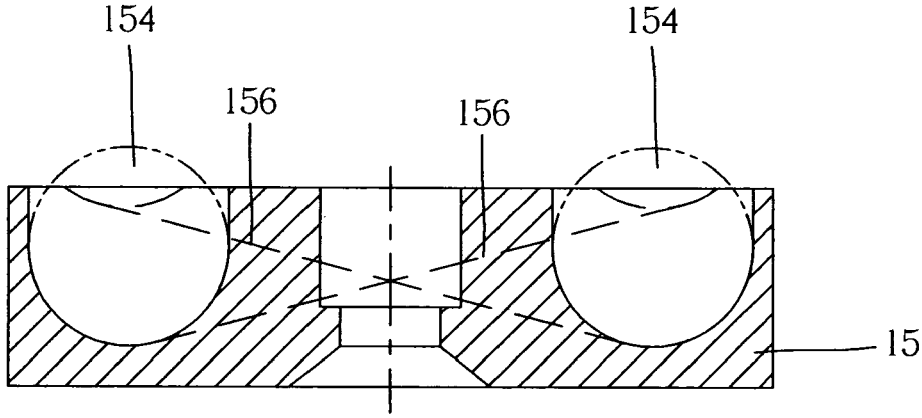
FIG. 6 is a plan cross-sectional assembly view of the damping device as shown in FIG. 4.

In operation, referring to FIGS. 1–8, each of the two urging balls 154 is initially received in the first end 1560 of a respective one of the two guide slots 156 of the action block 155 as shown in FIGS. 6 and 6A. Then, the motor 17 is operated by the electronic instrument 18 to rotate the action block 155 relative to the fixing disk 15, so that each of the two urging balls 154 is moved in the respective guide slot 156 of the action block 155. At this time, the depth of each of the two guide slots 156 of the action block 155 is gradually decreased from the first end 1560 to the second end 1562, so that each of the two urging balls 154 is pushed by the wall of the respective guide slot 156 of the action block 155 to push the fixing disk 15 to move relative to the magnetic disk 14 so as to change the distance between the magnetic members 151 of the fixing disk 15 and the magnetic disk 14.

Figure 7:
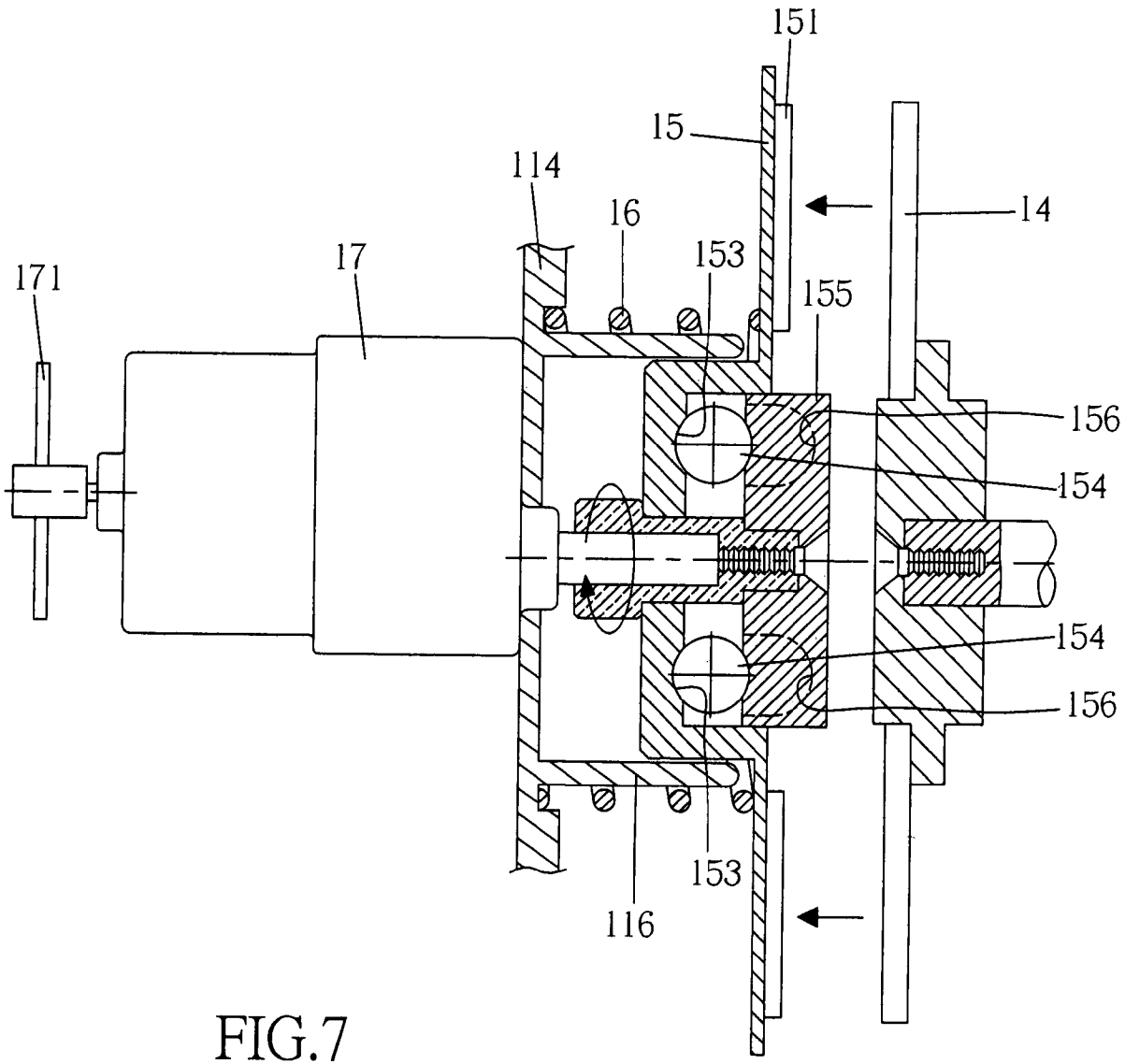
FIG. 7 is a schematic operational view of the damping device as shown in FIG. 5.
Figure 8A:
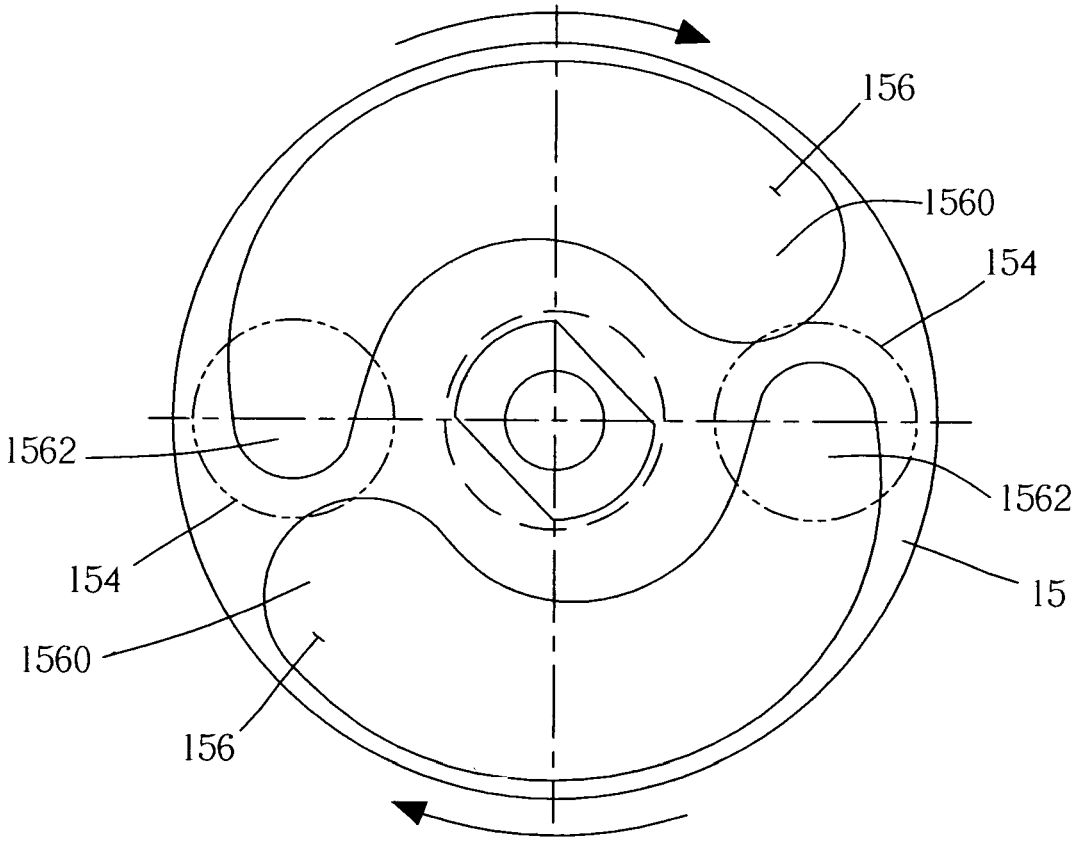
FIG. 8A is a schematic operational view of the damping device as shown in FIG. 6A.
Figure 8:
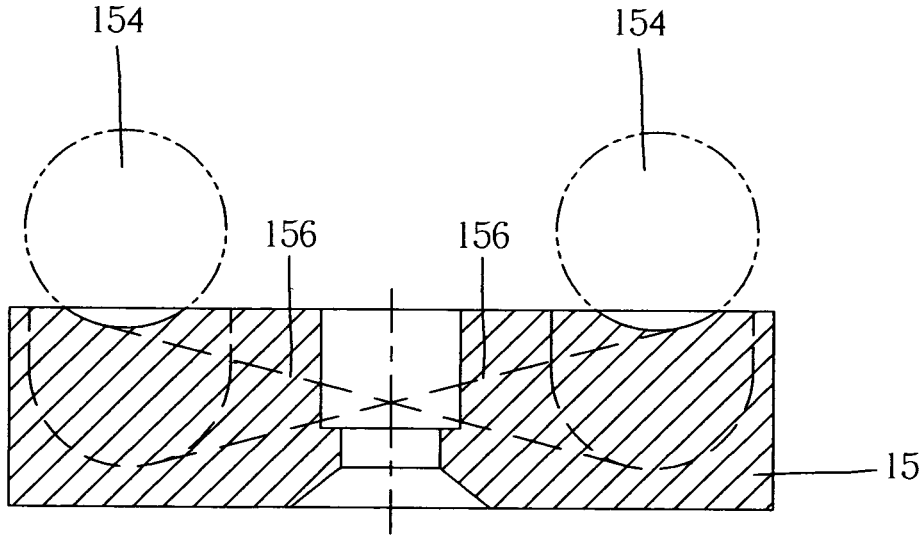
FIG. 8 is a schematic operational view of the damping device as shown in FIG. 6.

Thus, when each of the two urging balls 154 is received in the deeper first end 1560 of a respective one of the two guide slots 156 of the action block 155 as shown in FIGS. 6 and 6A, the distance between the magnetic members 151 of the fixing disk 15 and the magnetic disk 14 has the minimum value as shown in FIG. 5. Alternatively, when each of the two urging balls 154 is received in the shallower second end 1562 of a respective one of the two guide slots 156 of the action block 155 as shown in FIGS. 8 and 8A, the distance between the magnetic members 151 of the fixing disk 15 and the magnetic disk 14 has the maximum value as shown in FIG. 7.

In such a manner, when the distance between the magnetic members 151 of the fixing disk 15 and the magnetic disk 14 is increased, the magnetic force between the magnetic members 151 of the fixing disk 15 and the magnetic disk 14 is decreased, such that the damping force applied by the resistance wheel 13 on the rear wheel B of the exercising cycle is decreased. Alternatively, when the distance between the magnetic members 151 of the fixing disk 15 and the magnetic disk 14 is decreased, the magnetic force between the magnetic members 151 of the fixing disk 15 and the magnetic disk 14 is increased, such that the damping force applied by the resistance wheel 13 on the rear wheel B of the exercising cycle is increased.

Accordingly, the fixing disk 15 is pushed to move relative to the magnetic disk 14 by rotation of the action block 155 to change the distance between the magnetic members 151 of the fixing disk 15 and the magnetic disk 14, so as to adjust the damping force applied by the resistance wheel 13 on the rear wheel B of the exercising cycle, such that the resistance values of the damping device 1 can be adjusted arbitrarily so as to fit the requirements of different users. In addition, the damping device 1 can be operated easily and conveniently, thereby facilitating the user operating the exercising cycle. In addition, the infrared sensor 117 can read the rotation times of the code disk 171 of the motor 17, so that the microprocessor (not shown) mounted in the electronic instrument 18 can calculate the relative position of the fixing disk 15 via the infrared sensor 117 so as to calculate the damping values.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A damping device for an exercise bicycle, the device comprising:

a support base;

a housing secured on a side of the support base and having an inside formed with a receiving chamber, the housing including a first shell secured on the support base, a middle shell combined with the first shell and having a center formed with a mounting ring, and a second shell combined with the middle shell;

a pivot shaft rotatably mounted on the support base;

a resistance wheel coaxially secured on the pivot shaft to be rotatable therewith by a rear wheel of an exercise bicycle;

a magnetic disk mounted in the receiving chamber of the housing and secured on an end of the pivot shaft to rotate therewith;

a fixing disk movably mounted on the mounting ring of the middle shell at a distance from the magnetic disk and having a periphery provided with a plurality of magnetic members aligned with the magnetic disk, the fixing disk having a center formed with a receiving recess having a wall formed with two positioning holes;

an action block rotatably mounted in the receiving recess of the fixing disk and having a periphery formed with two symmetrical guide slots;

two urging balls each mounted in a respective one of the two positioning holes of the fixing disk and each slidably mounted in a respective one of the two guide slots of the action block; and a motor secured on an outer wall of the middle shell of the housing and having a first end provided with a rotatable spindle extended through the fixing disk and fixed in the action block for rotating the action block wherein rotation of the action block causes the urging balls to move within the guide slots which displaces the fixing disk relative to the magnetic disk.

2. The damping device in accordance with claim 1, wherein each of the two guide slots of the action block is arc-shaped.

3. The damping device in accordance with claim 1, wherein each of the two guide slots of the action block has a first end and a second end having a depth smaller than that of the first end.

4. The damping device in accordance with claim 3, wherein the depth of each of the two guide slots of the action block is gradually decreased from the first end to the second end.

5. The damping device in accordance with claim 1, wherein the support base is substantially U-shaped.

6. The damping device in accordance with claim 1, wherein the support base has two sides provided with two bearings, and the pivot shaft is extended through the two bearings.

7. The damping device in accordance with claim 1, wherein the first shell of the housing is substantially U-shaped.

8. The damping device in accordance with claim 1, wherein the second shell of the housing is substantially U-shaped.

9. The damping device in accordance with claim 1, wherein the middle shell of the housing is substantially U-shaped.

10. The damping device in accordance with claim 1, wherein the second shell of the housing has an inside provided with a substantially U-shaped infrared sensor, and the motor has a second end provided with a rotatable code disk having a periphery received in the infrared sensor.

11. The damping device in accordance with claim 1, wherein the magnetic members of the fixing disk are arranged in an annular manner.

12. The damping device in accordance with claim 1, further comprising an elastic member mounted on the mounting ring of the middle shell between the fixing disk and the middle shell for biasing the fixing disk toward the magnetic disk.

13. The damping device in accordance with claim 1, further comprising an electronic instrument connected to the motor.

14. The damping device in accordance with claim 3, wherein when each of the two urging balls is received in the first end of a respective one of the two guide slots of the action block, the distance between the magnetic members of the fixing disk and the magnetic disk has a minimum value.

15. The damping device in accordance with claim 3, wherein when each of the two urging balls is received in the shallower second end of a respective one of the two guide slots of the action block, the distance between the magnetic members of the fixing disk and the magnetic disk has a value greater than the minimum value.

* * * * *